United States Patent [19]

Allen et al.

[11] 4,066,182

[45] Jan. 3, 1978

[54] CONTAINER AND CLOSURE ASSEMBLY

[75] Inventors: David O. Allen; Harry A. E. Wombold, both of Wilmington, Ohio

[73] Assignee: Buckeye Molding Company, New Vienna, Ohio

[21] Appl. No.: 716,975

[22] Filed: Aug. 23, 1976

[51] Int. Cl.[2] ..... B65D 41/46

[52] U.S. Cl. ..... 215/256; 215/341

[58] Field of Search ..... 215/256, 254, 253, 341

[56] References Cited

U.S. PATENT DOCUMENTS

| | | | |
|---|---|---|---|
| 3,073,472 | 1/1963 | Williams | 215/256 |
| 3,407,957 | 10/1968 | Robinson | 215/251 |
| 3,913,772 | 10/1975 | Ochs | 215/256 |
| 3,928,109 | 12/1975 | Pollock | 215/241 X |
| 3,973,719 | 8/1976 | Johnson | 215/341 X |

*Primary Examiner*—Donald F. Norton

*Attorney, Agent, or Firm*—Dybvig & Dybvig

[57] ABSTRACT

A container and closure assembly of the type comprising a container having a neck surrounding an opening thereto and having a shoulder surrounding said neck, wherein the closure has a tear skirt having a radially outwardly projecting flange positioned for snug engagement with the container shoulder, thus to provide an insect barrier, said tear skirt having a pull tab for removal thereof, and said pull tab being rendered tamper resistant by having a radial outward projection not exceeding the radial outward projection of said flange and by integral attachment to said flange.

11 Claims, 5 Drawing Figures

CONTAINER AND CLOSURE ASSEMBLY

BACKGROUND OF THE INVENTION

1. Field of the Invention

This invention relates to the combination of a molded plastic closure with a container wherein the closure has flange means for coacting with a shoulder on the container so as to provide a barrier against insects, and wherein said flange means is integral with and sized with respect to a removable tear strip having a pull tab to shield the pull tab against an inadvertent operation thereof as by packaging machinery.

2. Prior Art

U.S. Pat. No. 3,407,957, particularly FIG. 1, illustrates a molded plastic closure having a tear strip for releasing the closure from engagement with a container and having a pull tab for use in removing the tear strip. The same patent discloses a protective flange shielding the pull tab against an inadvertent operation thereof as by packaging machinery. The flange also allows convenient stacking of the closures in cartons without encountering interference from the projecting pull tab.

U.S. Pat. No. 3,913,771, particularly FIGS. 19–21, illustrates a moldable plastic closure for a container capable of retaining therein a seal member for sealing the mouth of the container and having a removable dependent portion adapted to surround a projecting portion of the container and coact therewith to minimize insect infestation. Prior to removal of such tear strip, the tear strip provides a second function in revealing certain forms of tampering with the container and its closure.

SUMMARY OF THE INVENTION

In the present invention, a flange which shields a pull tab to be used in the removal of a tear strip or skirt is so positioned as to perform an additional function in cooperating with a shoulder on a container to form an effective insect barrier. Further, inasmuch as the insect barrier function is ordinarily no longer important after initial removal of the closure from its container, the flange which protects the pull tab is formed as an integral part of a removable tear skirt so that the flange will be removed as the tear skirt is removed, thus facilitating the ease with which the portions of the closure remaining after tear skirt removal can be used for container reclosure.

An object of the present invention is to provide a new and improved closure for use in combination with a container.

A further object of the present invention is to provide a closure having a removable tear strip, a pull tab for manipulation to remove the tear strip and a flange integral with the tear strip which shields the pull tab against inadvertent actuation.

It is a further object of the present invention to provide a closure having a flange for protecting a pull tab against inadvertent actuation, said flange also adapted to cooperate with a container shoulder to provide an insect barrier.

Other objects and advantages will become apparent from the following description and the drawings.

DESCRIPTION OF THE PREFERRED EMBODIMENT

Figure 1:
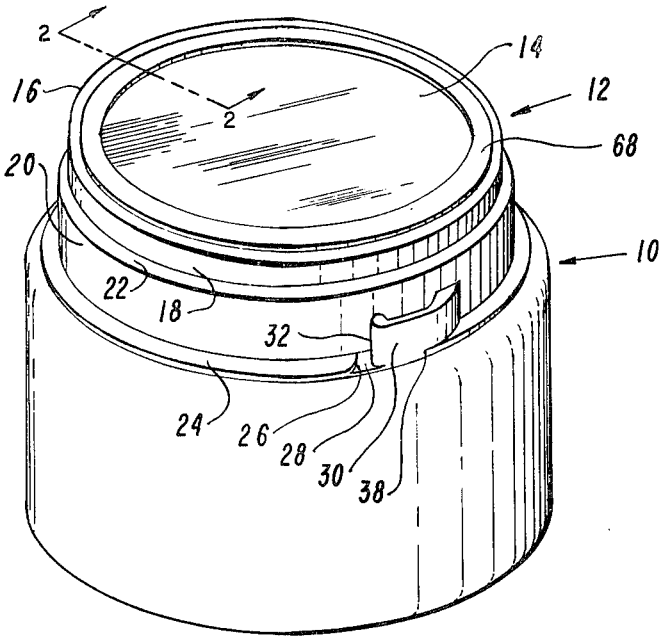
FIG. 1 is a fragmentary perspective view illustrating a container and closure in accordance with the present invention.

Referring to the drawings, the reference number 10 designates a container of a type suitably used in accordance with the present invention. The reference number 12 designates a closure in accordance with the present invention. The closure is preferably a one-piece, molded, thermoplastic body.

The closure 12 includes a generally flat panel 14 terminating with a marginal outer corner 16. Integral with and depending from the corner 16 is a skirt portion 18, which can, for convenience, be referred to as a reclosure skirt. The skirt portion 18 has an outwardly projecting shelf 22. Depending downwardly from the shelf 22 is an additional skirt 20, which, for convenience, can be referred to as a tear skirt. Projecting radially outwardly from the distal end of the tear skirt 20 is a flange 24.

The flange 24 can be seen to have a uniform thickness throughout the major portion of its circumferential extent, but has a step 26 to a circumferential portion 28 having a much smaller thickness. Integrally molded to the portion 28 as well as the flange 24 is a pull tab 30 having a finger grip bead 32 at one end thereof and an enlarged footing 36 securing the opposite end thereof to the body of the flange 24.

As appears in FIG. 1, the pull tab 30 is formed so as not to extend radially outwardly from the closure beyond the radial outward extent of the flange 24 and, as indicated by the reference number 38, has a radial outer surface which merges with the radial outer surface of the flange 24.

Figure 2:
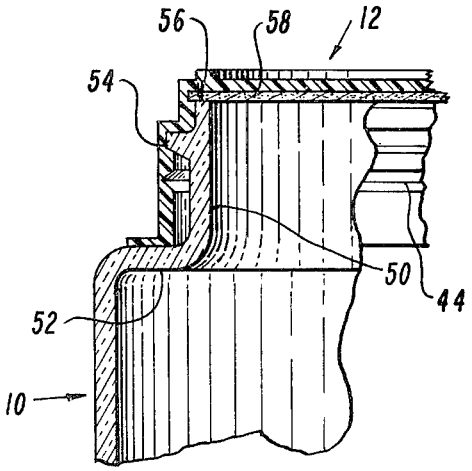
FIG. 2 is a fragmentary section view with a portion removed, taken substantially along the line 2—2 of FIG. 1.
Figure 5:
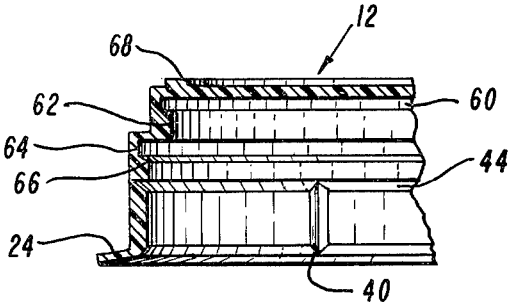
FIG. 5 is a fragmentary section view analogous to that of FIG. 2 which illustrates the closure in the absence of a container.

As best seen in FIGS. 2 and 5, the tear skirt 20 has a score line 44, which extends annularly about the inside margin of the skirt. Extending upwardly from approximately the lowermost surface of the flange 24, as it appears in FIG. 1, to the score line 44 is a vertical score line 40 located in the interior surface of the skirt 20. The score line 40 is located circumferentially in alignment with the edge of the footing which confronts the finger bead 32. The score line 44 is located axially at a level which coincides substantially with the upper level of the footing 36.

Assuming the closure 12 to be assembled on a container 10, as will be more fully described in a later portion of this specification, an individual seeking to gain access to the contents of the container can, by pulling on the pull tab 30, cause the pull tab to break away from the relatively thin portion 28 of the flange 24. Due to the fragility of the portion 28, it most typically occurs that the tab 30 will tear the flange portion 28 along a contour 29, which, in effect, follows the shape of the lower surface of the tab 30.

The pulling of the tab 30 causes the tear skirt 20 to break along the score line 40 so as to leave a vertically extending remnant edge 42, and further pulling of the tab 30 causes the skirt 20 to tear along the score line 44, leaving a remnant edge 48. Continued pulling of the tab 30 ultimately removes the entire distal portion of the skirt 20 which was formed below the remnant edge 48.

Figure 4:
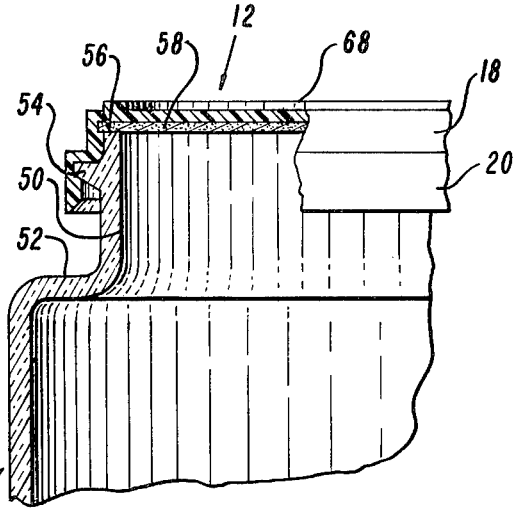
FIG. 4 is a fragmentary section view taken substantially along the line 4—4 of FIG. 3, the sectioning having been fragmentarily terminated to provide a side elevation illustration of the closure skirt after removal of the tear skirt.

Referring to FIGS. 2 and 4, the container, which may be of glass composition, may be of any desirable shape, such as a circular body, and preferably has a neck 50 having a shoulder 52 extending radially outwardly from the lower end of the neck. Projecting outwardly from the neck 50 above the shoulder 52 is a bead 54, which surrounds the neck and is used for retention of the closure. To this end, the skirt 18 is equipped with an annular channel 64 sized to engage and receive the container bead 54 with a snap fit. The neck 50 terminates at its upper margin as seen in FIG. 2, for example, with a relatively smooth, annular lip 56.

It is a common practice, particularly in the food industry, to provide a positive seal closing the opening to the container either before application of the closure to the container or while applying the closure to the container. FIGS. 2 and 4 accordingly illustrate a sealing member 59, which may be glassine, adhered to the lip 56 surrounding the opening to the container 10 by means of a suitable adhesive material 61, which may be, for example, a pressure-sensitive adhesive.

To aid in preserving a good seal between the sealing member and the lip of the container, the closure 12 has mounted therein a pulpboard liner 58, which is preferably retained to the closure by means of a re-entrant bead 62 forming the upper wall of the channel 64 and which was molded as a part of the closure and which is spaced from the closure panel 14 to define an annular groove 60 for receiving the peripheral margin of the pulpboard liner 58.

After the container 10 has been filled with its desired contents, the closure 12 is pressed by a rolling action onto the neck of the container 10 using conventional equipment well known in the art. Such equipment typically includes rolling means which are rolled across the top of the closure. In accordance with the present invention, the closure is provided with a rib 68 located so as to be aligned with the container lip 56; and when the closure is applied to the container 10 by a rolling action, the rib 68 serves as a pressure distributing means, which further pressurizes the pressure-sensitive adhesive 61 so as to firmly seal the opening to the container. The pressure distribution provided by the presence of the rib 68 also serves to compress the pulpboard liner 58 to conformity with the shape of the container lip 56 so that the pulpboard liner will be effective to buttress the seal between the sealing member 59 and the container lip 56, thus substantially minimizing the possibility that the adhesive bond provided by the adhesive layer 61 will fail as the container and its contents are shipped and perhaps subjected to jostling and shaking movements during shipment.

Those skilled in the art will also appreciate that the presence of the pulpboard liner 58 will serve to strengthen and somewhat rigidify the molded plastic closure 12, which, absent the pulpboard liner, may be quite flexible.

While the foregoing remarks have described the use of glassine together with a pressure-sensitive adhesive as one means for accomplishing an effective seal for protecting the contents of the container, it is also known in the art to use other forms of seal members, such as aluminum foil and the like, and other adhesives, such as hot melt adhesives. Also, while the foregoing remarks have described application of the sealing member 59 to the container before application of the closure 12, it is also known to first mount the sealing member to the closure as by loose attachment to the pulpboard liner 58 and then, after application of the closure 12 to the container, activating the adhesive associated with the sealing member 59 by heat and/or pressure, induction heating being particularly suitable in cases where the sealing member embodies a metallic foil in contact with the adhesive.

During shipment and storage of the assembled container and closure, the fit between the closure flange 24 and the upper surface of the container shoulder 52 is important for preventing the entry of small spiders and other insects under the flange 24. To minimize such possibility, the flange 24 is formed so as to slope downwardly at its lower surface, such slope appearing in FIG. 5. This shape to the flange 24, which may be duplicated in the lower surface of the pull tab 30, assures that the flange 24 will bear against the container shoulder 52.

A difficulty in handling closures of the type herein described has involved the likelihood of a premature rupture of the score line 40. In accordance with the present invention, the likelihood of a premature or accidental rupture of the score line 40 has been substantially reduced in two important respects. Firstly, the pull tab 30 is molded as an integral part of the closure flange 24 so that a force which is larger than ordinary handling forces is required to move or "operate" the pull tab 30. Secondly, the pull tab 30 is formed as most evident in FIG. 1 with a small radial profile, which does not extend beyond the radial outward projection of the closure flange 24.

Figure 3:
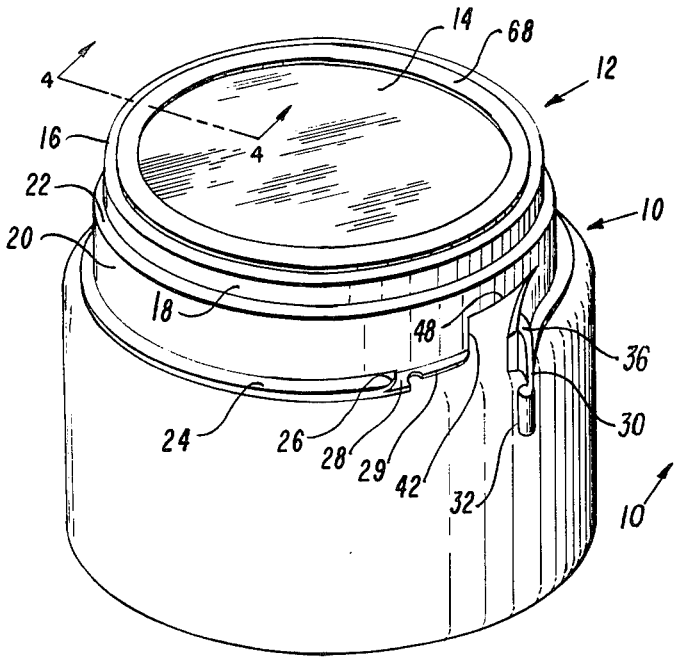
FIG. 3 is a fragmentary perspective view illustrating the condition of the container and closure after partial removal of a tear skirt.

FIG. 3 illustrates an approximate configuration of the closure 12 after the pull tab 30 has been manually manipulated to commence a tear along the score line 44. FIG. 4 illustrates the container and closure after complete removal of the portions of the skirt 20 which are formed below the score line 44. After removal of these portions of the tear skirt 20, the present invention contemplates that a sufficient gap will be provided under the remaining portions of the closure skirt 20 to enable an operator to place his fingers in the gap between the container shoulder 52 and the remaining portions of the closure 12 so as to pry the closure off the container by exerting only nominal forces.

Initial access to the container contents is gained by peeling the sealing member 59 away from the lip 56 or, alternatively, tearing at least a central portion of the sealing member so as to allow at least a portion of the contents of the container to be removed. Due to the manner in which the pulpboard liner 58 is entrapped in the closure groove 60, the pulpboard liner remains in the closure and is thus available for use in reclosing the container after an initial access to the contents of the container has been gained.

During the original closure of the container 10, the primary protection for the contents of the container resided in the sealing member 59, which was adhesively secured to the container lip 56. When opening the container, at least a part of the sealing member 59 was removed, and thus the contents of the container were no longer effectively protected by the sealing member. However, the closure 12 is formed, as best seen in FIG. 4, with a beveled bead 66 adapted to coact with the outwardly projecting bead 54 of the container to retain the closure 12 upon reclosure and to minimize contamination of the remaining contents of the container by the entry of airborne contaminants or debris between the container bead 54 and the beveled closure bead 66.

In addition to the advantages set forth in the preceding remarks, those skilled in the art will appreciate that the closure of the present invention provides a desirable tamper-indicating feature in that the first fracture to occur between the pull tab 30 and the portion 28 of the flange 24, whether caused by machine processing or an unauthorized attempt to invade the contents of the container, will be readily discernible.

Although the preferred embodiments of the present invention have been described, it will be understood that various changes may be made within the scope of the appended claims.

Having thus described our invention, we claim:

1. In a closure for a container of the type having a neck surrounding an opening to the container, having a shoulder surrounding said neck and spaced from said opening, and having closure retaining means supported by said neck between said shoulder and said opening; said closure comprising means for covering said opening to said container and a skirt for surrounding said neck, said skirt having means for engaging said retaining means and a first score line spaced from the distal end of said skirt to define one side of a tear-away portion, said tear-away portion having a pull tab affixed thereto, the improvement wherein the distal end of said tear-away portion has a circular flange projecting radially outwardly therefrom and extending peripherally therearound, wherein said pull tab is located between said flange and said means for covering said opening, and wherein the outward extension of said pull tab does not exceed the outward projection of said flange.

2. The closure of claim 1 wherein said pull tab is one piece with said flange.

3. The closure of claim 1 wherein said covering means is a panel integral with said skirt, and wherein said panel supports a pressure distributing rib having an outward extension less than the outward projection of said flange.

4. The closure of claim 3 wherein said covering means further includes a compressible liner disposed adjacent the interior surface of said panel, said skirt having liner retaining groove means receiving the periphery of said liner.

5. The closure of claim 1 wherein said pull tab has a footing integrally engaged with said tear-away portion between said flange and said first score line, said skirt having a second score line extending from said first score line adjacent said footing to approximately said flange, said first and second score lines disposed in an interior wall of said skirt.

6. The improvement of claim 1 wherein said flange slopes downwardly toward its outer margin and is adapted to engage said upper surface of said shoulder.

7. In combination, a container and a closure therefor, said container having a neck surrounding an opening thereto, an outwardly projecting shoulder spaced from said opening and surrounding said neck, and means disposed between said opening and said shoulder for retaining said closure, said shoulder having an upper surface facing generally toward the opening of said container; said closure comprising a skirt surrounding said neck and having means retentively engaged to said closure retaining means, said closure including a cover for said opening, said skirt having a score line spaced from the distal end of said skirt and defining a tear strip between said score line and said distal end, said tear strip having a distally located, annular and outwardly projecting flange surrounding said neck and engaging the upper surface of said shoulder, said tear strip further having a pull tab one piece with said tear strip projecting upwardly from said flange, the outward extension of said pull tab not exceeding the outward projection of said flange.

8. The combination of claim 7 wherein said flange is formed to slope downwardly and when assembly on said container bears against the upwardly facing surface of said shoulder.

9. The combination of claim 7 wherein said pull tab has a footing projecting upwardly from said flange integrally attached to said tear strip and a finger grip portion integrally attached to said flange.

10. The combination of claim 7 wherein said flange extends peripherally around said tear strip and has a first thickness throughout the larger portion of its peripheral extent and a second and smaller thickness adjacent said pull tab, said pull tab being integral with the portion of said flange having said second thickness.

11. In a closure for a container of the type having a neck surrounding an opening to the container, having a shoulder surrounding said neck and spaced from said opening, and having closure retaining means supported by said neck between said shoulder and said opening; said closure comprising means for covering said opening to said container and a skirt for surrounding said neck, said skirt having means for engaging said retaining means and a first score line spaced from the distal end of said skirt to define one side of a tear-away portion, said tear-away portion having a pull tab affixed thereto, the improvement wherein said tear-away portion has a flange extending peripherally therearound and projecting radially outwardly therefrom, said flange having a first thickness throughout the larger portion of its peripheral extent and a second and smaller thickness adjacent said pull tab, said pull tab being integral with the portion of said flange having said second thickness, and wherein the outward extension of said pull tab does not exceed the outward projection of said flange.

* * * * *